US009206540B2

(12) United States Patent
Lim et al.

(10) Patent No.: US 9,206,540 B2
(45) Date of Patent: Dec. 8, 2015

(54) WASHING MACHINE

(75) Inventors: Hee Tae Lim, Seoul (KR); Seon Ah Min, Seoul (KR); Kyu Hwan Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 643 days.

(21) Appl. No.: 13/069,919

(22) Filed: Mar. 23, 2011

(65) Prior Publication Data

US 2012/0240637 A1 Sep. 27, 2012

(51) Int. Cl.

| | |
|---|---|
| ***D06F 23/00*** | (2006.01) |
| ***D06F 37/20*** | (2006.01) |
| ***D06F 37/26*** | (2006.01) |
| *D06F 37/30* | (2006.01) |

(52) U.S. Cl.

CPC ..... *D06F 37/20* (2013.01); *D06F 37/269* (2013.01); *D06F 37/304* (2013.01)

(58) Field of Classification Search

CPC ..... D06F 37/206; D06F 37/269

USPC ..... 68/140

See application file for complete search history.

(56) References Cited

U.S. PATENT DOCUMENTS

| | | | | |
|---|---|---|---|---|
| 6,050,113 | A * | 4/2000 | Skrippek et al. | 68/140 |
| 2004/0163428 | A1 * | 8/2004 | Kim et al. | 68/140 |
| 2009/0100879 | A1 * | 4/2009 | Kim et al. | 68/140 |
| 2009/0113942 | A1 * | 5/2009 | Ha | 68/140 |
| 2009/0113943 | A1 * | 5/2009 | Lee | 68/140 |

* cited by examiner

*Primary Examiner* — David Cormier
(74) *Attorney, Agent, or Firm* — Dentons US LLP

(57) ABSTRACT

A structure of a driving part provided to a washing machine is disclosed. The present application provides the washing machine comprising a tub configured to store wash water therein; a drum rotatably installed in the tub and accommodating laundry therein; a driving shaft connected to the drum; at least one bearing configured to support the driving shaft; a motor mounted to an outer surface of a rear wall of the tub and connected to the driving shaft; and a bearing housing comprising a hub configured to accommodate the at least one bearing and a flange provided around the hub and coupled to a stator of the motor, the bearing housing buried in the rear wall of the tub.

11 Claims, 13 Drawing Sheets

WASHING MACHINE

BACKGROUND OF THE DISCLOSURE

1. Field of the Disclosure

The present invention relates to a washing machine which can wash laundry, more particularly, to a driving part configured to drive the washing machine.

2. Discussion of the Related Art

In general, washing machines are electric appliances which can wash laundry by using both detergent and mechanical friction. Such washing machines may be categorized into top-loading washing machines and front-loading washing machines. Those types of washing machines commonly include a tub (that is, an outer tub) configured to hold wash water therein and a drum (that is, an inner tub) located in the tub to perform washing for laundry received therein. Specifically, according to such a top-loading washing machine, a drum for accommodating laundry therein is vertically oriented in a housing of the washing machine, with a laundry introduction opening is formed in a top portion. Because of that, the laundry is loaded into the drum via the opening formed in a top portion of the housing which communicates with a drum opening of the drum. In contrast, according to such a front-loading washing machine, a drum for accommodating laundry therein is horizontally lying or oriented in a housing, with an opening facing a front of the washing machine. Because of that, the laundry is loaded into the drum via a laundry introduction opening formed in a front surface of the housing which communicates with the opening of the drum. Both of the top-loading washing machine and the front-loading washing machine include doors coupled to the housings to open and close each opening of the housings, respectively.

A driving structure of the washing machine may be categorized into an indirect connection structure and a direct connection structure. According to the indirect structure, a drum accommodating laundry therein and a motor have pulleys, respectively. The pulleys are connected with the drum and the motor via belts indirectly, and a variety of mechanisms capable of connecting the drum and the motor with each other indirectly may be usable. In contrast, according to the direct connection structure, a rotor provided in a motor is connected with a drum directly.

The front-loading type washing machine has a compact size and it damages little fabric, compared with the other type washing machines. Also, the direct connection structure can transfer a power of the motor to the drum with almost no loss. Those advantages make the front-loading type washing machine having the direct connection structure consumed broadly.

In the various types of washing machines as mentioned above, the motor is mounted to a rear wall of the tub in the front-loading type washing machine and it is mounted on a bottom surface of the tub in the top-loading type washing machine. Especially, in case of the direct connection structure, the motor may be directly attached to the tub for efficient power transfer. However, the motor would be quite heavy because it includes a stator having a metal core. Moreover, the motor, in other words, the rotor is rotated at a high speed during the operation of the washing machine and much vibration is applied to the tub accordingly. Because of that, a coupling part formed in the tub to couple the tub and the motor to each other is subject to damage because of the weight of the motor and the vibration. As a result, it is important to provide the tub with sufficient rigidity and strength.

In addition, the various types of the washing machines have been under development to be able to wash the laundry effectively and conveniently. Nevertheless, it will be continuously required to improve various aspects of the washing machines, for example, washing capacity increase, productivity increase and noise/vibration decrease and the like.

SUMMARY OF THE DISCLOSURE

An object of the present invention is to provide a washing machine which includes a structurally reinforced tub.

Another object of the present invention is to provide a washing machine which has a high productivity in a manufacturing process.

A further object of the present invention is to provide a washing machine which can enhance a washing capacity, even without increasing an overall profile thereof.

A further object of the present invention is to provide a washing machine which can reduce noise and vibration.

To achieve these objects and other advantages, the present application provides a washing machine comprising a tub configured to store wash water therein; a drum rotatably installed in the tub and accommodating laundry therein; a driving shaft connected to the drum; at least one bearing configured to support the driving shaft; a motor mounted to an outer surface of a rear wall of the tub and connected to the driving shaft; and a bearing housing comprising a hub configured to accommodate the at least one bearing and a flange provided around the hub and coupled to a stator of the motor, the bearing housing buried in the rear wall of the tub.

The bearing housing may be disposed in the rear wall of the tub, not to be exposed to an outside of the rear wall. The bearing housing may be entirely enclosed by the rear wall of the tub. An outer surface of the bearing housing may be entirely covered by the rear wall of the tub.

The flange may be extended outwardly along a radial direction from the hub. The flange may be extended from an end of the hub adjacent of the drum. The flange may include a first extension extended obliquely from an end of the drum adjacent to the drum. The flange may include a second extension extended from the first extension outwardly along a radial direction, perpendicular to a center axis of the hub.

The bearing housing may include a plurality of radial ribs and a plurality of circumferential ribs provided on the flange.

The bearing housing may include a plurality of chambers provided to the flange and receiving the rear wall of the tub.

The objectives and other advantages of the invention may be realized and attained by the structure particularly pointed out in the written description and claims hereof as well as the appended drawings. Additional advantages, objects, and features of the disclosure will be set forth in part in the description which follows and in part will become apparent to those having ordinary skill in the art upon examination of the following or may be learned from practice of the invention.

It is also to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate example(s) of the disclosure and together with the description serve to explain the principle of the disclosure. In the drawings.

DESCRIPTION OF SPECIFIC EMBODIMENTS

Reference will now be made in detail to the specific examples of the present invention, which are illustrated in the accompanying drawings. Wherever possible, the same reference numbers will be used throughout the drawings to refer to the same or like parts. The present invention is explained in reference to a front-loading type washing machine as shown in the accompanying drawings, but it is also applicable to a top-loading type washing machine even with no substantial modifications.

Figure 1:
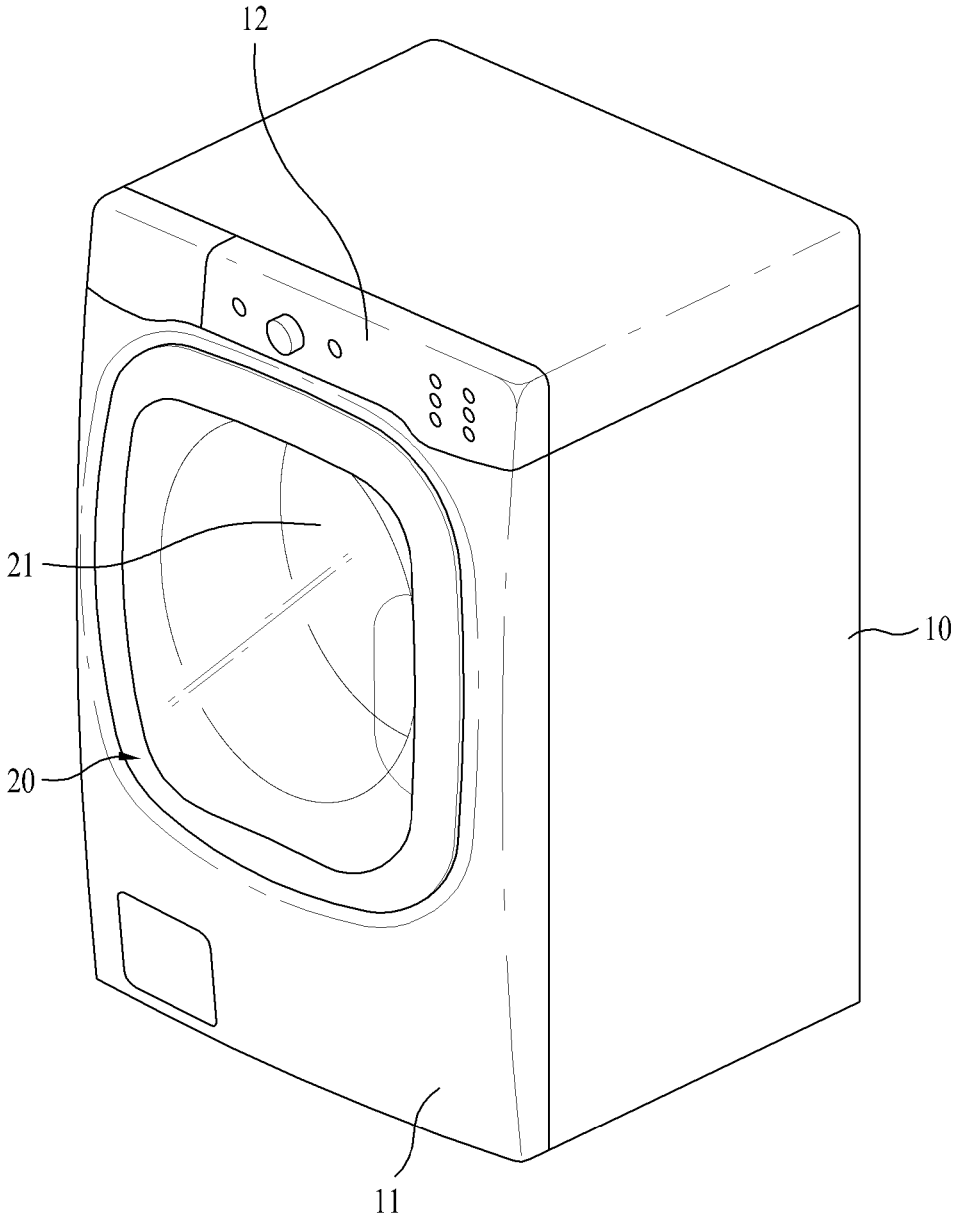
FIG. 1 is a perspective view illustrating a washing machine according to one example of the present invention.
Figure 2:
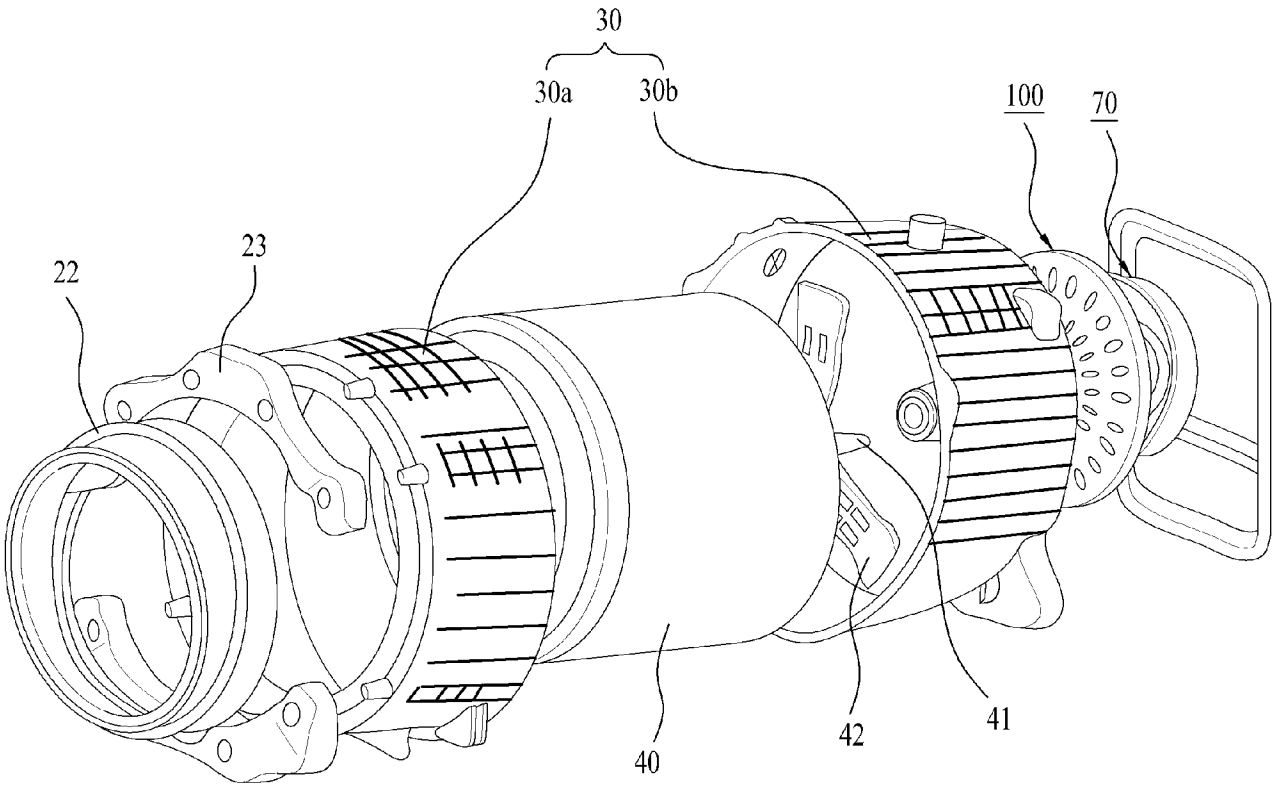
FIG. 2 is a perspective view illustrating inner devices provided in the washing machine.

FIG. 1 is a perspective view illustrating a washing machine according to an example of the present invention and FIG. 2 is a perspective view illustrating inner devices provided in the washing machine.

As shown in FIG. 1, the washing machine includes a housing 10 defining a profile thereof and a variety of components required to perform washing may be installed in the housing 10. A front cover 11 is coupled to a front of the housing 10 to define a front of the washing machine. To instruct an operation of the washing machine, a control panel 12 is provided on the housing 10. The front of the housing 10, that is, the front cover 11 has an opening and the opening is opened and closed by a door 20 coupled to the housing 10. The door 20 is typically circular-shaped and it can be manufactured to have a rectangular shape, as shown in FIG. 1. Such a rectangular door 20 allows a user to see an inside of the washing machine easily and the rectangular door 20 is advantageous to improve an exterior appearance of the washing machine. A door glass 21 is secured to the door 20 and the user may see the inside of the washing machine to identify a state of laundry through the door glass 21.

FIG. 2 shows a variety of devices installed in the housing 10. First, a tub 30 is installed in the housing 10 to hold wash water. The tub 30 may comprise a front portion 30*a* and a rear portion 30*b* coupled to each other. A drum 40 is rotatably mounted in the tub 30 and receives laundry to perform washing. The tub 30 and the drum 40 are horizontally lying or oriented, to allow openings formed therein to face the front of the housing 10. The openings of the tub and the drum 30 and 40 are in communication with the opening of the housing 10, as mentioned above. Once the door 20 is open, the user can load the laundry into the drum 40 via the openings of the tub/drum 30 and 40 and the housing 10. A gasket 22 may be provided between the opening of the housing and the tub 30 to prevent leakage of wash water. A balance weight 23 may be installed to the tub 30 to reduce vibration and to distribute the laundry uniformly. The tub 30 may be formed of plastic to reduce to raw material cost and an overall weight. The drum includes a plurality of through-holes to allow the wash water of the tub 30 to enter the drum 40. Additionally, the washing machine may be configured to have a drying function to dry washed-laundry or clothes. For the drying function, the washing machine may include a heater configured to generate hot air and a duct structure and a fan configured to supply and circulate the generated hot air to the drum 40 although not shown in the drawings. Furthermore, to enhance washing and drying functions, the washing machine may be configured to supply steam to the laundry. Although not shown in the drawings, the washing machine may include a heating device configured to generate the steam and a nozzle and a variety of devices configured to supply the steam to the drum 40.

In addition, a driving device may be installed to the tub 30, and the drum 40 is rotated by the driving device to wash the laundry. As shown in FIG. 2, the driving device includes a motor 70 disposed on a rear wall of the tub 30. The motor 70 directly rotates the drum 40 by using a driving shaft 41. More specifically, a front end of the driving shaft 41 is coupled to a rear wall of the drum 40. The front end of the driving shaft 41 may be directly connected with the rear wall of the drum 40. However, for stable coupling and power transfer, the front end of the driving shaft 41 is coupled to a spider 42 and this spider 42 is mounted to the rear wall of the drum 40. Such a driving shaft 41 passes through the rear wall of the tub 30, and a rear end of the driving shaft 41 is coupled to the motor 70 located outside the tub 30 as shown in FIGS. 3 and 4.

The motor 70 includes a stator 50 and a rotor 60. Firstly, the stator 50 is mounted to the rear wall of the tub 30 as shown in FIGS. 3 and 4. The stator 50 is illustrated in detail in FIG. 5, which shows a bottom thereof. Considering a mounting state shown in FIGS. 3 and 4, the stator 50 is installed to the tub rear wall with being oriented vertically, and the bottom is arranged adjacent to the rear wall of the tub 30. Therefore, according to an actual orientation of assembly, the bottom shown in FIG. 5 becomes a front portion of the stator 50, facing the rear wall of the tub 30. The stator 50 has a core to generate a magnetic field. As shown in an overall profile of the stator illustrated in FIG. 5, the core comprises a base having a ring shape and teeth extended from the base in a radial direction. The core may be manufactured in various types and it is preferable that the core is a helical core. The helical core may be formed by winding in a helical direction, a metal strip with predetermined shapes (i.e. a base and teeth). This helical core can reduce material loss and simplify a manufacturing process. A coil 52 is wound around the teeth as shown in FIG. 5. The stator 50 includes an insulator 51 enclosing the core and the insulator 51 has a predetermined shape corresponding to the core described above. In other words, as shown in FIG. 5, the insulator 51 includes a base portion 51*a* enclosing the base of the core and a teeth portion 51*b* enclosing the teeth of the core. As mentioned above, since the helical core is formed by winding the stripe, much stress is applied to the stripe while the helical core is manufactured. Especially, since great stress is concentrated on an inner circumferential surface of the core base, it is difficult for the core itself to have a fastening part formed on the inner circumferential surface to fasten the stator to the rear wall of the tub. Accordingly, a fastening part 53 is formed on an inner circumferential surface of the insulator 51, that is, an inner circumferential surface of the base part 51*b*, instead of the inner circumference of the core. The fastening part 53 is a part of the insulator 51. That is, the fastening part 53 extends inwardly in a radial direction from the inner circumferential surface of the insulator 51. Also, the fastening part 53 extends over both ends (front and rear ends) of the inner circumferential surface of the insulator 51 to have a proper rigidity. The fastening part 53 includes a fastening hole 53*a* through which a fastening member passes, and an pipe-shaped reinforcing member may be inserted into the fastening hole 53*a* to reinforce the fastening hole 53*a*. Thus, using the fastening part 53 and the fastening member, the stator 50 is mounted to the rear wall of the tub 30.

Figure 3:
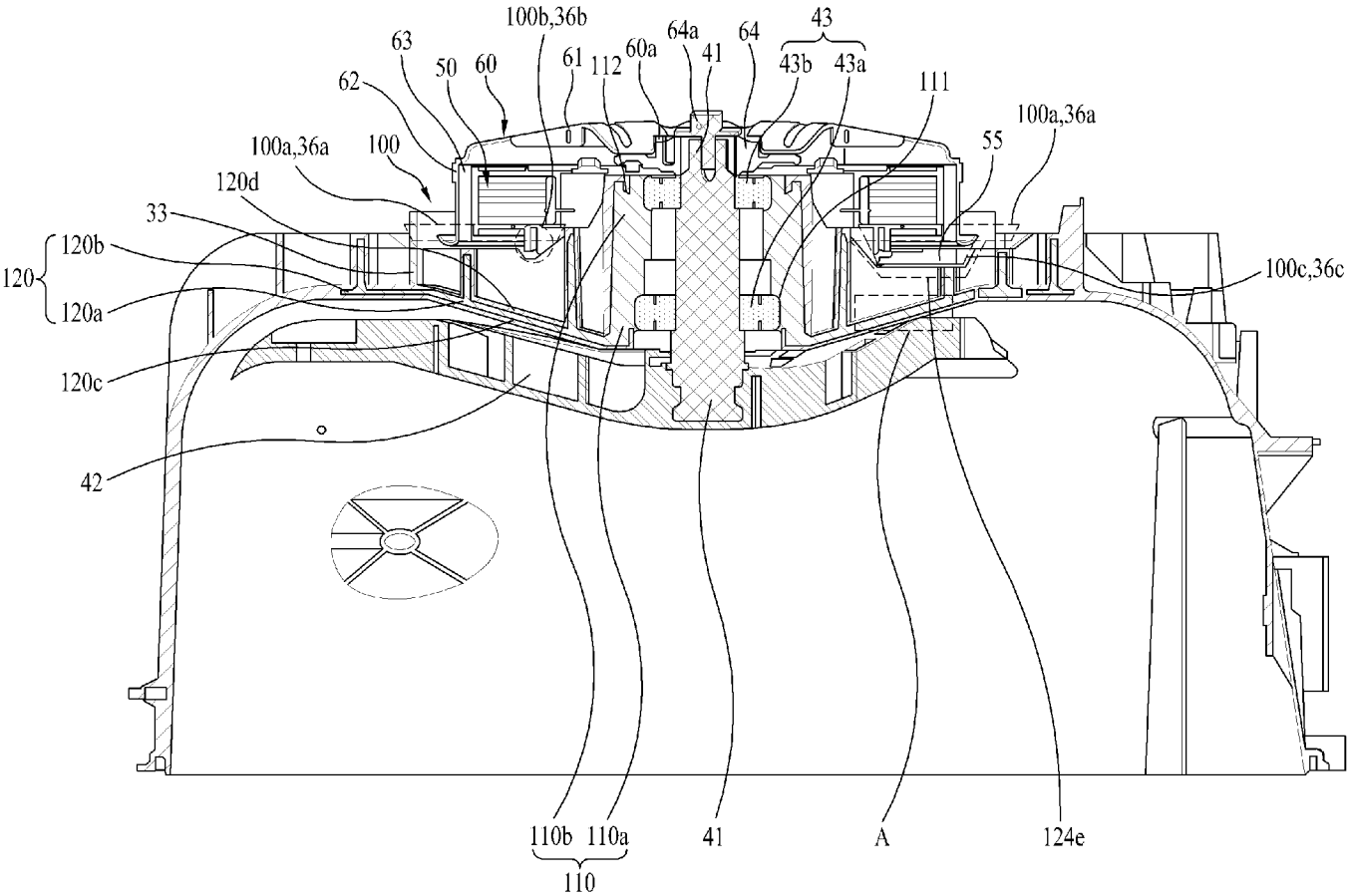
FIG. 3 is a sectional view illustrating a tub-bearing housing assembly.
Figure 4:
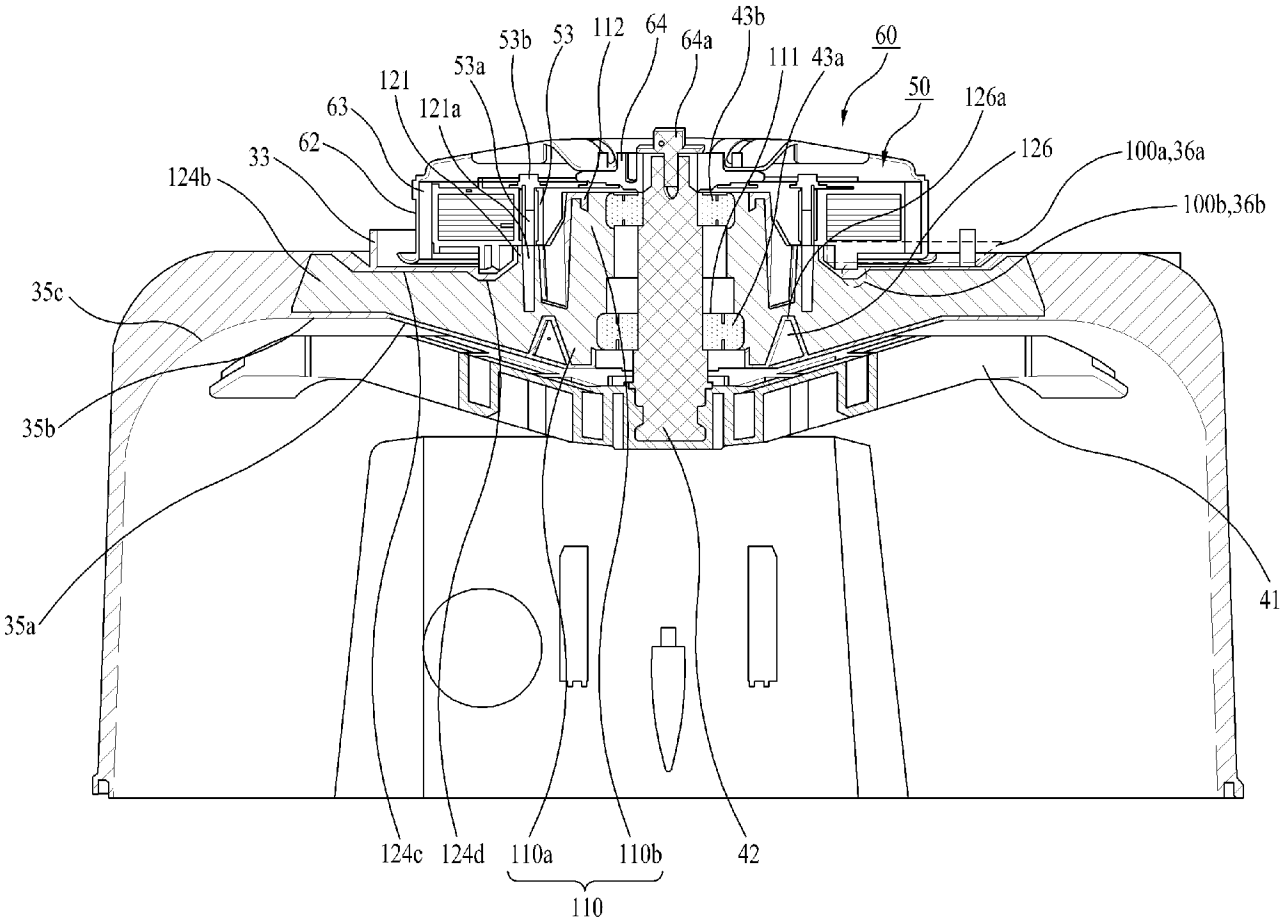
FIG. 4 is a sectional view additionally illustrating the tub-bearing housing assembly.
Figure 5:
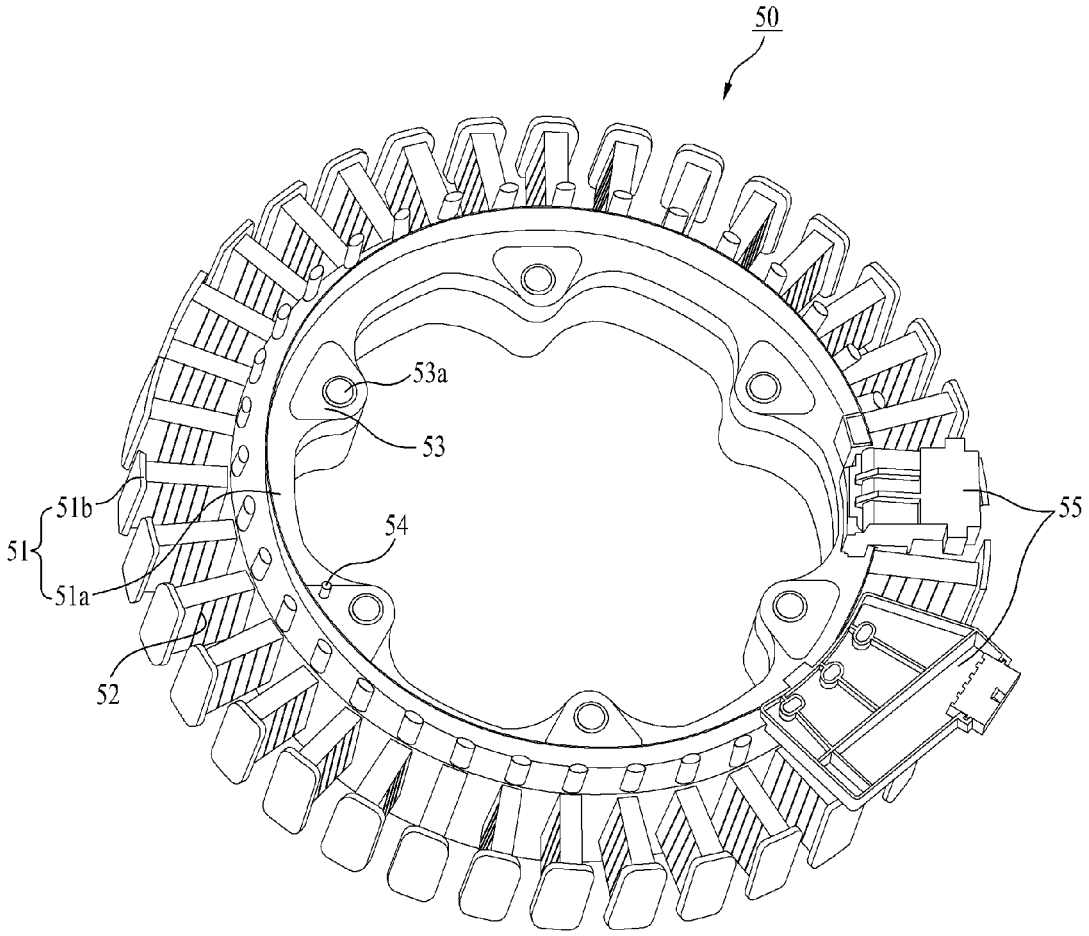
FIG. 5 is a perspective view illustrating a bottom portion of a stator.

As shown in FIGS. 3 and 4, the rotor 60 is configured to surround the stator 50 and, thus the stator 50 is arranged within the rotor 60. That is, the rotor 60 corresponds to an outer rotor, and the motor 70 corresponds to an outer rotor motor because of such an arrangement of the rotor and stator. The rotor 60 includes a first frame 61 extending from a center thereof in a radial direction and a second frame 62 extending from the first frame 61, generally parallel to a center axis of the rotor 60. A hub 60*a* is formed in a center of the first frame 61 and the hub 60*a* has a through hole formed therein. The second frame 62 is spaced apart a predetermined distance from ends of the teeth, and extends parallel to end surfaces of the teeth, In addition, a seating part is formed on an inner circumferential surface of the second frame 62 and a permanent magnet 63 is arranged on the seating part, facing the teeth of the stator 50. In detail, as shown in the drawing, the first frame 61 inclines by a predetermined angle. More specifically, the first frame 61 inclines toward the stator 50 or the tub 30. As a result, the first frame 62 is compact enough not to interfere with the other neighboring devices and a wall of the housing 10. Even if the tub 30 is tilted together with the motor 70, the first frame 61 which already inclines makes the rotor 60 not projected toward the wall of the housing 10 which is adjacent to the rotor 60. Rather, in this case, the inclining first frame 61 could be arranged parallel to the wall of the housing 10 adjacent to the first frame 61, with maintaining a predetermined distance. As a result, the rotor 60 may not be interfered with the wall of the housing 10 due to the first frame 61. For these reasons, even if the washing machine includes the tilted tub 30, drum 40 and motor 70, the washing machine does not need to expand the housing 10 to avoid the interference with the rotor 60, and it can even have the housing 10 of the reduced size.

The rotor 60 uses a connector 64 to be connected with the driving shaft 41. The connector 64 is inserted in the hub 60*a* of the rotor 60 and then is coupled to the rotor 60, exactly, the first frame 61 using the coupling member. The rear end of the driving shaft is inserted into the connector 64, and is coupled to the connector 64 using the coupling member 64*a*. Therefore, the rotor 60 is coupled to the driving shaft 41 by means of the connector 64, and thereby a rotational force of the rotor 60 could be directly transferred to the drum 40 connected with the driving shaft 41. The connector 64 is made of a plastic material which is an insulating material and prevents electricity from leaking into the drum 40 from the rotor 60 via the driving shaft 41. Accordingly, the connector 64 may prevent the user from getting an electric shock. In addition, as the plastic connector 64 can dampen vibration, it prevents the vibration of the rotor 60 generated during a high speed rotation from being transferred to the driving shaft 41.

Figure 12:
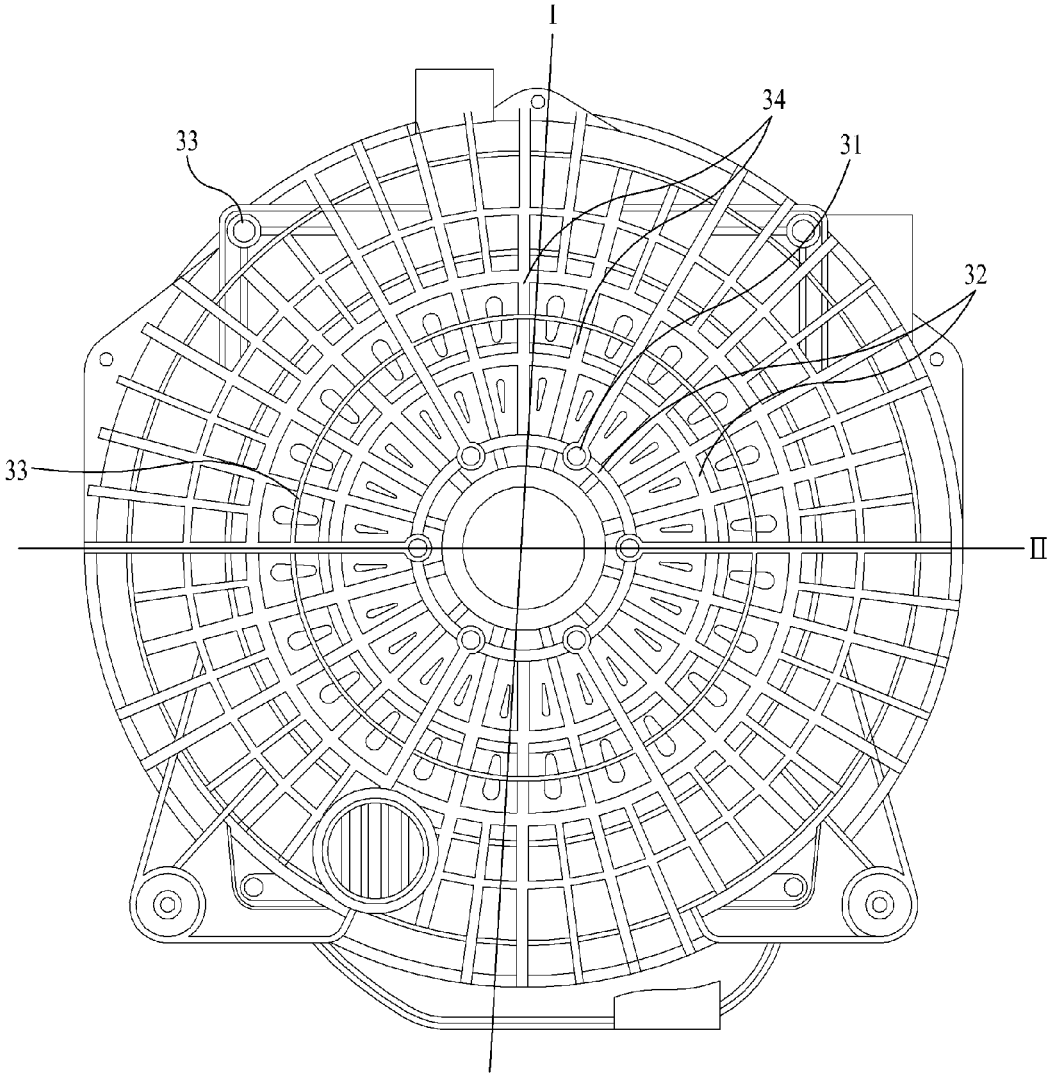
FIG. 12 is a perspective view partially illustrating an outer portion of the tub-bearing housing assembly.

The driving shaft 41 is rotated by the motor 70 at a high speed, and at the same time, the weights of the drum, the laundry and the wash water are loaded on the driving shaft 41. Thus, at least one bearing 43 is provided to the driving shaft 41 to rotatably support the driving shaft 41. To provide the at least one bearing 43 to the driving shaft 41, a structure configured to accommodate and support the bearing 43 is required. For that purpose, a bearing housing 100 is provided to the washing machine. The bearing housing 100 is illustrated in detail in FIGS. 6 to 9 as well as FIGS. 3 and 4. First of all, FIG. 3 illustrates a section of an assembly of the bearing housing and the tub (hereinafter, a tub-bearing housing assembly), and such a section of FIG. 3 is taken along I-I line of FIG. 12 to clearly show a flange and circumferential ribs of the bearing housing which will be described in the followings. FIG. 4 also illustrates the section of the tub-bearing housing assembly, and such a section of FIG. 4 is taken along II-II line of FIG. 12 to clearly show radial ribs which will be described in the followings as well. FIG. 12 does not include the motor mounted to the rear wall of tub in order to definitely show which portions of the bearing housing are cut by I-I and II-II lines and also to clearly show the shape of the tub rear wall itself. However, assuming that the motor is mounted to the state of FIG. 12, FIGS. 3 and 4 show cross sections of the driving shaft 41, the spider 42, the stator 50 and the rotor 60 mounted to the tub 30, in addition to the sections of the tub and the bearing housing inserted therein. Further, FIGS. 6 to 9 are perspective views, a plane view and a side sectional view illustrating the bearing housing.

As shown well in all the drawings mentioned above, the bearing housing 100 may include a hub 110 configured to receive the bearing 43. Further, the bearing housing 100 may include a flange 120 coupled to the stator 50. The flange 120 is provided around the hub 110. The hub 110 and the flange 120 may be formed as separate members. Alternatively, the hub 110 and the flange 120 may be formed as one body. The integral formation of the hub 110 and the flange 120 can allow the bearing housing 100 to have a high stiffness and strength and to stably support the stator 50 coupled thereto. The hub 110 may be formed as one body with the rub 30. The flange 120 may be formed as one body with the tub 30, separately. Specifically, the hub 110 may be formed as one body with the rear wall of the tub 30. The flange 120 may be formed as one body with the rear wall of the tub 30. Various methods can be applied to such an integral formation, for example, insert-injection molding may be used. For such a molding, the tub 30 may be made of plastic to reduce the material cost and the entire weight and may be molded by using a mold. In contrast, the bearing housing 100 may be made of a metallic material to secure the required stiffness and strength. For example, the bearing housing 100 may be made of alloy of aluminum and it may be molded by die casting. In the insert-injection molding, the bearing housing 100 is manufactured in advance and the manufactured bearing housing 100 is inserted in the mold of the tub. Specifically, the bearing housing 100 is disposed in a predetermined space in the mold provided to form a rear wall. After that, dissolved plastic is injected into the mold. Accordingly, the bearing housing 100 and the tub 30 (that is, the rear wall of the tub) are integrally formed as one body. Since the bearing housing 100 has the high stiffness and strength as described above, the tub 30 (that is, the rear wall of the tub) is structurally reinforced by such an integral formation. If the bearing housing 100 is manufactured separately from the rear wall of the tub, an additional process for mounting the bearing housing 100 to the tub 30 is required. However, if the bearing housing 100 and the tub 30 are integrally formed as one body as mentioned above, there is no need of additional processes and members for assembling the bearing housing to the tub. As a result, since a manufacturing process can be simplified and further members for assembling the bearing housing and the tub may not be required, the production cost is lowered and the productivity is increased.

Moreover, the bearing housing 100 may be inserted into the rear wall of the tub 30 via the integral formation process. That is, the hub 110 may be inserted into the rear wall of the tub 39. Separate from the hub 110, the flange 120 may be inserted into the rear wall of the tub 30. Such the inserted bearing housing 100 may be exposed to an outside of the tub 30. For example, surfaces of the bearing housing 100 of FIGS. 3 and 4 adjacent to the stator 50 may be exposed, not covered by the rear wall of the tub 30 entirely. In this case, since the bearing housing 100 is not covered with the rear wall of the tub 30 entirely, a molding process for the tub 30 may be simplified with the lowered cost of production. However, such the exposed bearing housing 100 may be easily separated from the tub 30 by vibration and load applied to the bearing housing 100 repeatedly. For that reason, the bearing housing 100 may be buried in the rear wall of the tub 30 as shown in FIGS. 3 and 4. That is, the hub 110 may be buried in the rear wall of the tub 30. The flange 120 also may be buried in the rear wall of the tub 30. Further, the hub 110 and/or the flange 120 may be embedded in the rear wall of the tub 30. That is, the hub 110 and/or the flange 120 may be disposed in the rear wall of the tub 30 not being exposed to the outside of the tub 30. More specifically, the hub 110 may be enclosed by the rear wall of the tub 30, and separately, the flange 120 may be enclosed by the rear wall of the tub 30. Further, the hub 110 may be entirely enclosed by the rear wall of the tub 30, and separate from the tub 110, the flange 120 may be entirely enclosed by the rear wall of the tub 30. Shortly, an overall outer surface of the hub 110 and/or the flange 120 may be covered by the rear wall of the tub 30. Alternatively, the hub 110 and/or the flange 120 may be disposed between an outer surface and an inner surface of the rear wall of the tub. Alternatively, at least surface of the hub 110 and/or the flange 120 adjacent to the stator 50 may be covered by the rear wall of the tub 30. Moreover, at least surface of the hub 110 and/or the flange 120 adjacent to the stator 50 may be entirely covered by the rear wall of the tub 30. Alternatively, the rear wall of the tub may be disposed between the stator 50 and the flange 120 and it covers the flange 120. Likewise, the rear wall of the tub may be disposed between the stator 50 and the hub 110 and it covers the hub 110. As the buried bearing housing 100 as described above basically accompanies the insert-injection molding, the productivity can be enhanced and the cost of production can be lowered. In addition, as the rear wall of the tub covers the overall outer surface of the bearing housing 100, a contact area between the bearing housing 100 and the rear wall of the tub 30 is increased and the coupling strength between them is greatly increased. This increased coupling strength results in substantial improvement of the stiffness and strength of the tub rear wall itself. As a result, the tub rear wall and the bearing housing 100 stably support the motor 70, especially, the heavy stator 50, and are not damaged by the load and vibration applied thereto repeatedly.

As follows, the bearing housing 100 described above will be explained in detail in reference to relating drawings.

Referring to FIGS. 3 and 4, the hub 110 receives the bearing 43 therein and a predetermined portion of the driving shaft 41 to allow the bearing 43 to support the driving shaft 41. As shown in the drawings, the hub 110 comprises a cylinder member having a predetermined space formed therein. The hub 110 is disposed at the center of the tub rear wall, and extends along the center axis of the tub. Therefore, the hub 110 includes a first end 110*a* adjacent to the drum 40 and a second end 110*b* adjacent to the motor 70 (that is, the rotor 60 or the stator 50). Considering actual orientation of the assembled components shown in FIGS. 3 and 4, the first end 110*a* and the second end 110*b* are corresponding to a front end portion and a rear end portion of the hub 110. If a portion supported by the bearing 43 is great, the driving shaft 41 may be rotatable more stably. Thus, the hub 110 is extended as much as possible. More specifically, the hub 110 is extended from an inner surface or an inner portion of the rear wall of the tub 30. Considering substantial orientation of the tub shown in FIGS. 3 and 4, the inner surface or the inner portion of the tub rear wall corresponds to a front surface or a front portion of the tub 30. Further, the hub 110 reaches the connecting portion between the rotor 60 and the driving shaft 41. The hub 110 is extended adjacent to or extended up to the connecting portion between the rotor 60 and the driving shaft 41. In other words, the hub 110 is extended near a rear end of the driving shaft 41. Accordingly, the hub 110 has a considerable length enough to support most portions of the driving shaft 41 securely. Moreover, the hub 110 may be projected a predetermined distance from the rear wall of the tub 30 because of the great length from the inner surface of the rear wall of the tub 30 to the connecting portion between the rotor 60 and the driving shaft 41.

A plurality of bearings may be provided in the hub 110 in order to support the driving shaft 41 more securely. For example, front and rear bearings 43*a* and 43*b* are installed in front and rear portions of the hub 110, respectively, to support front and rear portions of the driving shaft 41, respectively. A step 111 is formed at inner surfaces of the hub 110. Motion of the bearings 43*a* and 43*b* is limited by the step 111, and thus the bearings 43*a* and 43*b* are not separated from the hub 110. A groove 112 is formed at the rear end portion of the hub 110, that is, the second end. Such a groove 112 is shown well in FIGS. 6 and 8 as well as FIGS. 3 and 4. Specifically, the groove 112 is formed at an end surface of the hub 110 which faces the rotor 60 and it is extended along a circumferential direction. As a profile could be varied drastically at an edge of the end portion of the hub 110, the plastic used to form the tub 30 might not be completely coated on the edge during the molding process. Further, for the same reason, the portion of the tub 20 attached to such an edge could be separated easily. However, melted plastic fills up the groove 112 during the molding process. Therefore, in the finished tub-bearing housing assembly, the groove 112 is filled with the solidified plastic, that is, a portion of the tub 30. The groove 112 allows the edge of the end portion of the tub 30 to have a broad contact surface with the hub 110. As a result, the portion of the tub 30 attached to the edge of end portion of bearing housing 100 is not easily separated from the hub 110 and the coupling strength between the tub 30 and the hub 110 is increased.

As shown in FIGS. 3, 4, 6 and 7, the flange 120 is provided around the hub 110. The flange 120 extends outwardly in a radial direction. The flange 120 may be partially formed on an outer circumference of the hub 110. However, as shown in the drawings, the flange 120 may be formed on the entire outer circumference of the hub 110. Such a flange 120 may substantially increase the stiffness and strength of the rear wall of the tub 30 as well as of the bearing housing 100. The flange 120 may be provided around or extended from any portion of the hub 110, including a second end 110*b*, a middle portion and a first end 110*a* of the hub 110. However, as described above, the hub 110 has the significant length reaching the connecting portion between the rotor 60 and the driving shaft 41, and the tub 30 is formed to cover the flange 120. As a result, the flange 120 provided to the second end 110*b* or the middle portion would unnecessarily increase the thickness of the rear wall of the tub 30 and the volume of a rear portion of the tub-motor assembly. For that reason, the flange 120 may be provided around or extended from the first end 110*a* of the hub 110 adjacent to the drum 40. For the same reason, the flange 120 may be provided around or extended from a front or middle portion of the hub 110. Such a flange 120 reduces the thickness of the rear wall of the tub 30 entirely, and thereby makes the washing machine compact.

The flange 120 may be provided around or extended from the hub 110 without any slope, in other words, perpendicular with respect to a center axis of the hub 110. However, the tub 30 is basically formed to enclose the flange 120. As it is expectable from the sectional views of FIGS. 3 and 4, such a flat flange 120 moves the inner surface of the tub rear wall adjacent to the drum 40 (i.e., a front surface of the tub rear wall as shown in the drawings) toward the drum 40, entirely. Therefore, it is difficult to design the drum 40 having a large capacity. For that reason, the flange 120 includes a first extension 120*a* obliquely provided around or extended from a front end of the hub 110, that is, the first end 110*a* or the front portion of the hub 110 which is adjacent to the drum 40. As shown in the drawings, the first extension 120*a* inclines toward the motor 70. The first extension 120*a* also inclines away from the drum 40. Such the first extension 120*a* reduces the thickness of the tub rear wall and is advantageous for designing the drum 40 with a large capacity. In addition, the inclined first extension 120*a* brings an effect that a cross section of the flange 120 is substantially increased as much as a region (A) indicated by dotted line, and thus increases the stiffness and strength of the bearing housing 100 and the tub 30. Also, as the inclined first extension 120*a* traverses the rear wall of the tub 30, the rear wall of the tub 30 is structurally reinforced. Meanwhile, it is required for the flange 120 to extend outwardly in a radial direction as long as possible to further reinforce the rear wall of the tub 30. However, if flange 120 comprises the inclined first extension 120*a* only, the lengthened flange 120 has a substantial great height at the end of the flange 120. This height of the flange 120 may be the reason of tub thickness increase as mentioned above. Accordingly, the flange 120 includes a second extension 120*b* extended outwardly in a radial direction from the first extension 120*a* without the inclination, i.e., to be flat. Specifically, the second extension 120*b* is provided around or extended from the first extension 120*a* outwardly in a radial direction, with being perpendicular to the center axis of the hub 110. Such the second extension 120*b* allows the flange 120 to have a predetermined size enough to reinforce the stiffness and strength of the flange 120 as well as of the rear wall of the tub 30, and also maintains the proper size of the tub rear wall. Accordingly, the second extension 120*b* is advantageous in making the washing machine compact. The flange 120 including the first and second extensions 120*a* and 120*b* is formed to have a diameter corresponding to ⅔ of a diameter of the tub rear wall. Alternatively, as shown in FIGS. 3 and 4, the flange 120 is extended to a starting point of a curved portion 35*c* of the inner surface (that is, the front surface) of the tub rear wall. That size is substantially required to structurally reinforce the flange as well as the rear wall. In addition, the first extension 120*a* is extended beyond the motor 70, that is, beyond the rotor 60. In other words, a diameter of the first extension 120*a* is larger than a diameter of the motor 70, that is, a diameter of the rotor 60. The first extension 120*a* having such a size is advantageous in increasing the capacity of the drum 40 within the same sized tub, not increasing the thickness of the tub rear wall. Further, as shown in FIGS. 3 and 4, the flange 120 further includes a first surface 120*c* adjacent to the drum 40 and a second surface 120*d* adjacent to the motor 70 (that is, the rotor 60 or the stator 50), besides the first and second extensions 120*a* and 120*b*. In view of substantial orientation of assembled components shown in FIGS. 3 and 4, a first surface 120*c* and a second surface 120*d* corresponds to front and rear surfaces of the flange 120. The flange 120 may have a plurality of through-holes 120*e* as shown in the drawings. In other words, the bearing housing 100 includes a plurality of through holes 120*e* formed in the flange 120. During the molding process, the plurality of the through-holes 120*e* allows the melted plastic to pass therethrough. The melted plastic flows via the through-holes 120*e*, to be distributed on an entire surface of the bearing housing 100 uniformly. As a result, the plurality of the through-holes 120*e* helps the bearing housing 100 get in uniform contact with the tub rear wall and increases the adhesion strength between them. Once the molding is completed, the plurality of the through-holes is filled with the tub rear wall. Due to the through-holes 120*e*, the contact area between the tub rear wall and the bearing housing 100 greatly increase and the adhesion strength between them also increases.

Further, the bearing housing 100 includes a fastening boss 121 formed on the flange 120. The fastening boss 121 is fastened to the stator 60. The fastening boss 121 is well shown in FIGS. 3, 4, 6 and 8. The fastening boss 121 is extended from the flange 120 toward the stator 50. In other words, the securing box 121 is extended backwardly from the flange 120. In view of this configuration, the fastening boss 121 is disposed on the flange 120, adjacent to the motor 70. More specifically, the fastening boss 121 is disposed on the second surface 120*d* adjacent to the motor, not on the first surface 120*c* of the flange. The fastening boss 121 is extended substantially parallel to the center axis of the hub 110. The bearing housing 100, i.e. the flange 120 may have the plurality of the fastening bosses 121 as shown in the drawings and the plurality of the securing bosses 121 may be arranged around the hub 110 with the same diameter from a center of the housing 100. Circumferential distances between each two of the fastening bosses 121 are identical. Therefore, the stator 50 is fastened to the fastening bosses 121 securely. Also, as the stator 50 is quite heavy, the fastening bosses 121 are required to have a high stiffness and strength to stably support and fasten the stator. Therefore, the fastening bosses 121 are formed on the first extension 120*a* basically having a high Stiffness and strength.

The fastening boss 121 has a fastening hole 121*a* formed therein. As shown in FIG. 4, the fastening part 53 of the stator 50 is aligned with the fastening boss 121 such that the fastening hole 53*a* communicates with the fastening hole 121*a* of the fastening boss 121. Then, the fastening member 53*b* is fastened to the fastening hole 121*a*, passing through the fastening hole 53*a*. With fastening the fastening part 53 to the fastening boss 121, the stator 50 is coupled to the flange 120 (that is, the first extension 120*a*) of the bearing housing 100 and at the same time, is mounted on the rear wall of the tub 30.

Moreover, as shown in FIGS. 3, 4 6, and 8, the bearing housing 100 may include circumferential ribs 122 and radial ribs 124 formed on the flange 120. In addition, the bearing housing 100 may include a partition 123 formed on the flange 120. The ribs 122 and 124 and the partition 123 are extended from the flange 120 toward the motor, that is, the stator 50. In other words, the ribs 122 and 124 and the partition 123 are extended from the flange 120 backwardly. In view of such a configuration, the ribs 122 and 124 and the partition 123 are disposed on the flange 120, adjacent to the motor 70. More specifically, the ribs 122 and 124 and the partition 123 are disposed on the second surface 120*d* adjacent to the motor. In addition, the circumferential ribs 122 and the partition 123 are extended substantially parallel to the center axis of the hub 110. These ribs 122 and 124 and the partition 123 increases the stiffness and strength of the tub rear wall as well as of the bearing housing, remarkably.

Referring to related drawings, the ribs 122 and 124 and the partition 123 will be described in detail as follows.

In the circumferential ribs 122, the bearing housing 100 includes a first circumferential rib 122*a* disposed adjacent to the hub 110. The first circumferential ribs 122*a* are continuously extended along a circumferential direction around the hub 110. The first circumferential rib 122*a* has a constant diameter, that is, a constant distance with respect to the center of the bearing housing 100. More specifically, the first circumferential rib 122*a* connects the fastening bosses 121 with each other. With the first circumferential rib 122*a*, the fastening bosses 121 are structurally strengthened. Further, the bearing housing 100 includes a second circumferential rib 122*b* extended along a circumferential direction and disposed adjacent to the first circumferential rib 122*a*. That is, the second circumferential rib 122*b* is spaced apart from the first circumferential rib 122*a* in a radial direction. The second circumferential rib 122*b* has a constant diameter with respect to the center of the bearing housing 100 and the diameter of the second circumferential rib 122*b* is greater than that of the first circumferential rib 122*a*. Such a second circumferential rib 122*b* is employed to reinforce the stiffness and strength of the middle portion of the flange 120.

The bearing housing 100 includes the partition 123 formed at the end of the flange 120 in the radial direction. The partition 123 is extended in the circumferential direction along the radial end of the flange 120. The partition 123 is extended to be higher than the second circumferential rib 122*b*, at least. Such the partition 123 is employed to reinforce the end of the flange 120 which is structurally weak. In addition, the partition 123 stops flow of the melted plastic during the molding, and thus have the melted plastic remain on the flange 120. That is, the melted plastic is locked up between the partition 123 and the hub 110. Accordingly, the bearing housing 100, especially, the ribs 122 and 124 gets in contact with the plastic uniformly by the partition 123, and the adhesion strength between the bearing housing and the tub rear wall is enhanced. Meanwhile, a profile of the bearing housing 100 is changed greatly at the edge where the partition 123 meets the end of the flange 120. Thus, the tub rear wall might be then easily separated from such an edge. For this reason, the bearing housing 100 includes an auxiliary flange 123*a* extended outwardly in a radial direction from the partition 123. The auxiliary flange 123*a* may comprises an auxiliary extension further extended from the flange 120, exactly, the second extension 120*b*. The auxiliary flange 123*a* reduces the profile change at the edge and increases the contact area with the tub rear wall. Therefore, the adhesion strength between the bearing housing 100 and the tub rear wall may be reinforced. An auxiliary rib 123*b* may be formed between the partition 123 and the auxiliary flange 123*a*. The auxiliary rib 123*b* reinforces the auxiliary flange 123*a* as well as the partition 123. Furthermore, the bearing housing 100 may has a recess 123*c* formed at the radial end of the flange 120. Specifically, the recess 123*c* is provided at an outer circumferential portion of the partition 123. The recess 123*c* receives the melted plastic in the molding process, and thereby receives a predetermined portion of the tub rear wall in the completed tub-bearing housing assembly. Such the recess 123*c* increases the contact area between the bearing housing 100 and the tub rear wall and increases the adhesion strength between them accordingly. The recess 123*c* may be relatively formed by the partition 123, the auxiliary flange 123*a* and the auxiliary rib 123*b* which are adjacent to one another as shown in the drawing. The recess 123*c* may be formed by cutting out of a predetermined portion of radial end of the flange 120 or a predetermined portion of the partition 123. The radial end of the bearing housing 100 may be structurally reinforced by the partition 123, the auxiliary flange 123*a*, the auxiliary rib 123*b* and the recess 123*c* described above.

Figure 6:
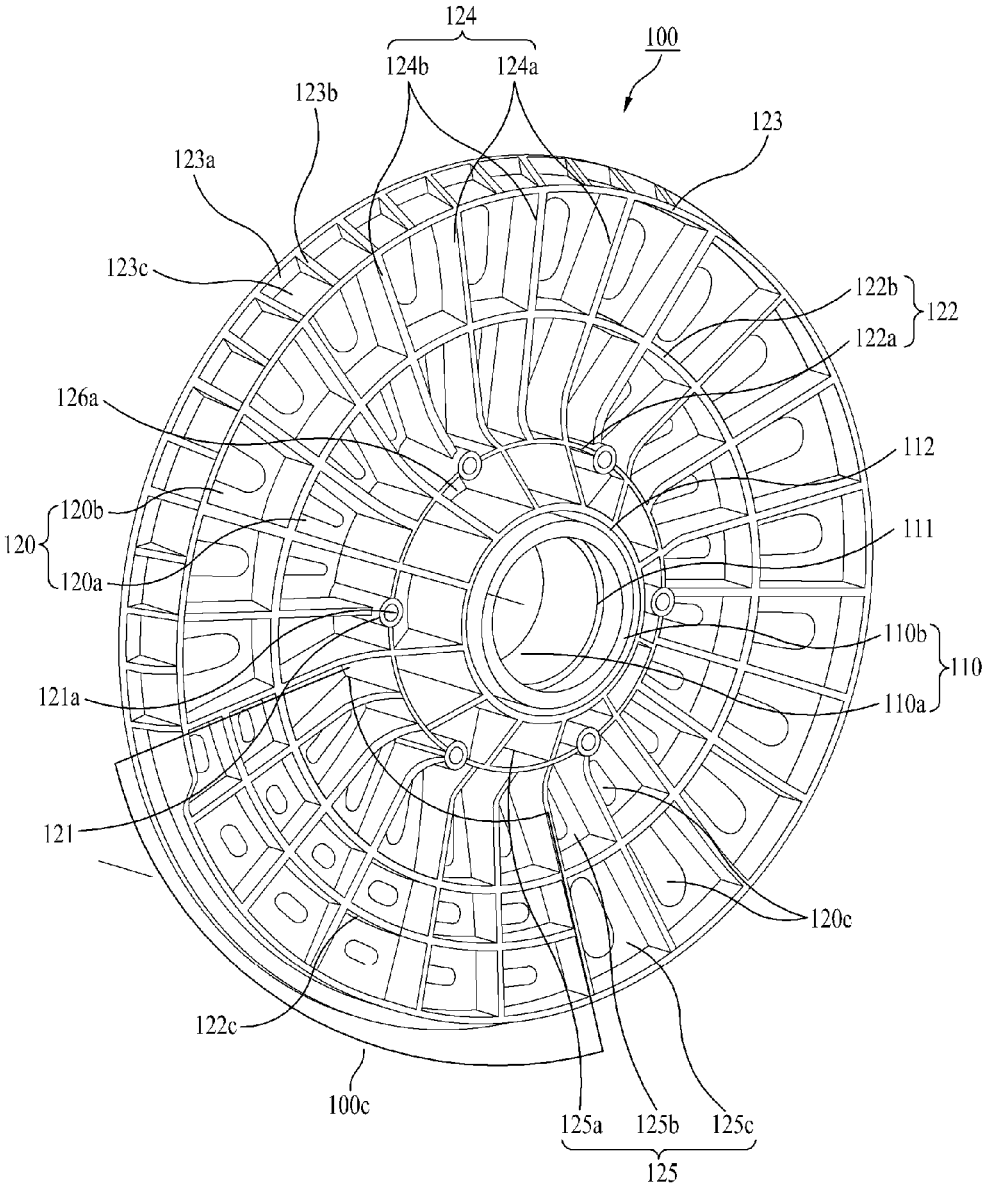
FIGS. 6 and 7 are perspective views illustrating rear and front portions of a housing.
Figure 8:
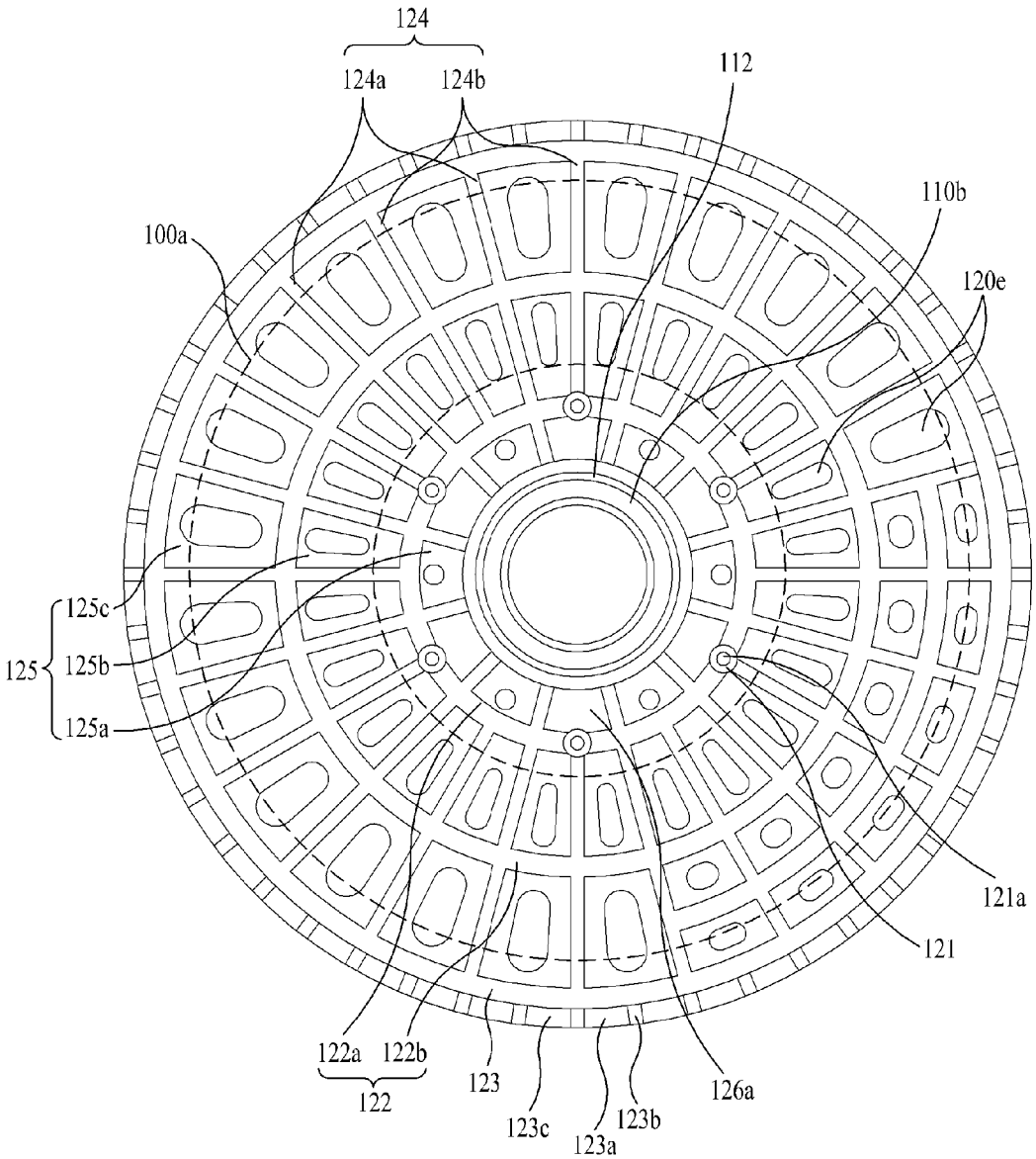
FIG. 8 is a plane view illustrating the rear portion of the bearing housing.
Figure 9:
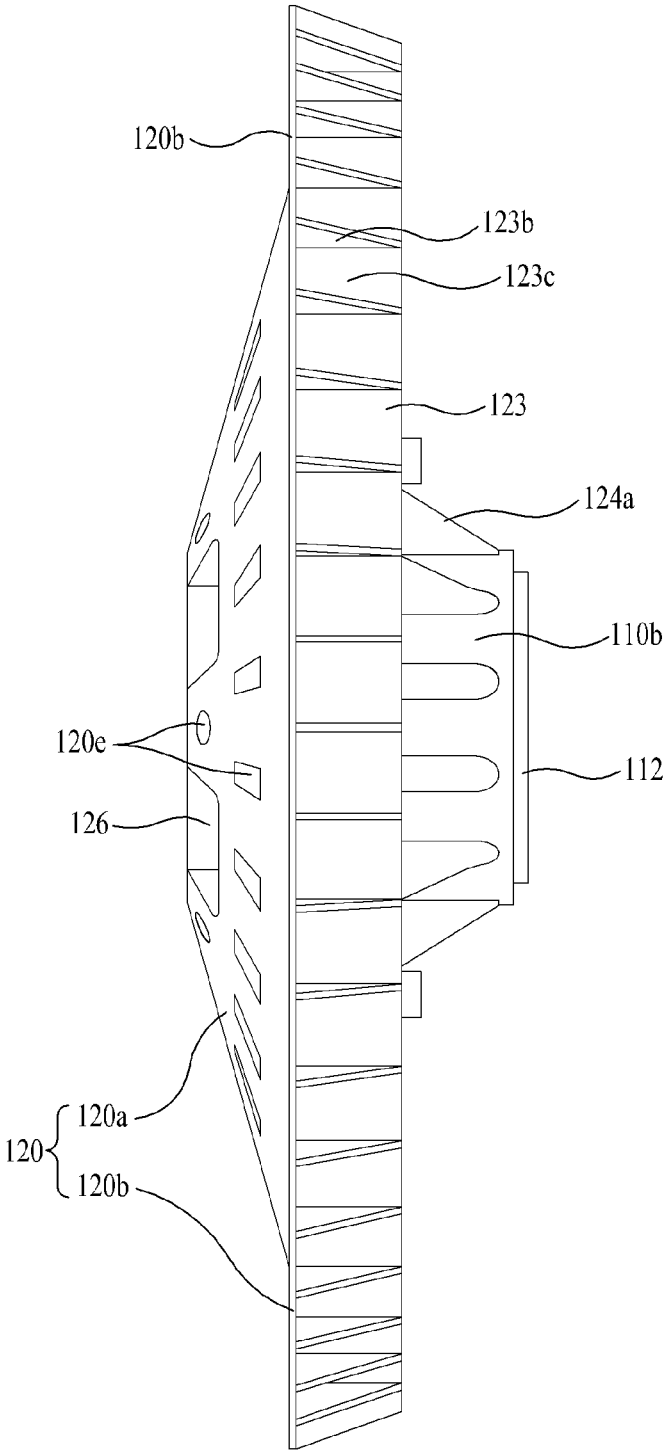
FIG. 9 is a side sectional view illustrating the housing.

In the radial ribs 124, the bearing housing 100 includes at least one first radial rib 123*a* disposed on the flange 120, as shown in FIGS. 6 and 8. It is preferable that the bearing housing 120 includes a plurality of first radial ribs 124*a* to reinforce stiffness and strength. The first radial ribs 124*a* may be continuously extended from the hub 110 to the radial end of the flange 120. As shown in FIGS. 4, 6 and 9, the first radial ribs 124*a* may be arranged with the same distance along a circumferential direction. At a portion connected to the hub 110, the first radial ribs 124*a* have a predetermined height from the flange 120 to the second end 110*b* located in a rear portion of the hub 110, in order to support the hub 110 securely. If the first radial rib 124*a* maintains in other portions thereof, the same height at the connected portion with the hub 110, the tub 30 has a thickness increased to cover such radial rib 124*a* and the sizes of the tub and the washing machines may be increased. Therefore, as shown in the drawings, the first radial rib 124*a* has a height decreased gradually along a radial direction, so as not to increase the thickness of the tub rear wall. That is, end of the first radial rib 124*a* which is adjacent to the motor may incline toward the flange 120. The gradually decreased height may be formed at predetermined portions of the first radial ribs 124*a* which is adjacent to the hub 110. The thickness of the tub rear wall may not increased by such first radial ribs 124*a* and the stator 50 may be disposed closer to the tub rear wall. Accordingly, the tub-motor assembly becomes compacter by the first radial ribs.

Moreover, as shown in FIGS. 4, 6 and 8, the bearing housing 100 includes second radial ribs 124*b* disposed between the first radial ribs 124*a* on the flange 120. Similar to the first radial ribs 124*a*, the bearing housing 120 may include the plurality of the second radial ribs 124*b* for the structural strength. The second radial ribs 124*b* may be disposed with the same distance along a circumferential direction. The second radial rib 124*b* may be extended from the hub 110 to the radial end of the flange 120 like the first radial rib 124*a*. However, in this case, the distance between the first and second radial ribs 124*a* and 124*b* becomes quite narrow near the hub 110 and the manufacture of the baring housing 100 is difficult accordingly. For such a reason, the second radial ribs 124*b* are not connected to the hub 110. More specifically, the second radial ribs 124*b* may be extended from predetermined portions spaced apart from the hub 110 to the radial end of the flange 120. Preferably, the second radial ribs 124*b* are connected to the first circumferential ribs 122*a* and this connection allows the first radial ribs 122*a* and the second radial ribs 124*b* to support each other. Furthermore, the second radial ribs 124*b* are connected to the fastening bosses 121, to support the securing bosses 121.

As shown in FIGS. 3, 4 and 8, the bearing housing 100 includes a first recess configured to receive the stator 5. In other words, a predetermined portion of the stator is inserted in the first recess 100*a*. This first recess 100*a* is disposed on the middle portion of the flange 120 in a radial direction. Further, the first recess 100*a* is extended even in a circumferential direction. Accordingly, the stator 60 may not be projected greatly from the tub rear wall and the tub-motor assembly may be then compact. A projection which can have various shapes may be formed at a predetermined portion of the stator 50 adjacent to the tub rear wall. The projection is formed by the insulator and this is unavoidable in aspect of design of the stator 50. Therefore, as shown in FIGS. 3 and 4, the bearing housing 100 may include a second recess 100*b* to receive the projection. As shown in FIG. 5, the stator 50 has a variety of accessories 55 provided at a predetermined portion thereof adjacent to the tub rear wall. The accessories 55 may be a terminal, a sensor for detecting the location of the rotor and the like. As shown in FIGS. 4 and 6, the bearing housing 100 may include a third recess 100*c* configured to receive those accessories 55. The projection of the insulator and the accessories 55 are located in the predetermined portion of the stator 50 adjacent to the tub rear wall, which is already received by the first recess 100*a*, that is, the front portion of the stator 50 as shown in the drawings. The second and third recesses 100*b* and 100*c* are connected to or communicating with the first recess 100*a* to accommodate the projection and the accessories 55, with being further projected forwardly from the first recess 100*a* as shown in the drawings. As a result, the second and third recesses 100*b* and 100*c* together with the first recess 100*a* substantially receive the stator 60, to help the tub-motor assembly, especially, the tub rear wall to be compact. To form the first to third recesses 100*a*, 100*b* and 100*c*, the heights of predetermined portions of the circumferential and radial ribs 122 and 124 adjacent to the projection and the accessories 55 may be lowered. More specifically, the circumferential and radial ribs 122 and 124 may have cut-out portions 124*c*, 124*d* and 124*e* adjacent to the stator 50. These cut-out portions 124*c*, 124*d* and 124*e* may form the first, second and third recesses 100*a*, 100*b* and 100*c*, respectively. As shown in FIGS. 3 and 6, the third recess 100*c* makes the heights of the neighboring ribs remarkably decreased and the stiffness and strength of the bearing housing 100 may be relatively decreased at the third recess 100*c*. Therefore, as shown in FIG. 6, an auxiliary circumferential rib 122*c* may be formed adjacent to the third recess 100*c* to supplement the stiffness and strength.

The bearing housing 100 further includes a plurality of chambers 125 formed on the flange 120. The chambers 125 may be shown in FIGS. 6 and 8 in detail. In view of the configurations in the drawings, the chambers 125 may comprise recesses. That is, the chambers 125 may comprise partially open chambers. The chambers 125 are disposed on the flange, to be adjacent to the motor 70, i.e. to face the motor 70. Specifically, the chambers 125 are disposed on the second surface 120*d* adjacent to the motor. More specifically, the chambers 125 are serially disposed along the radial direction of the bearing housing 100. The chambers 125 are serially disposed along the circumferential direction of the bearing housing. Such chambers 125 accommodate the tub rear wall. In other words, the chambers 125 are filled with the tub rear wall. Alternatively, walls of the chambers 125 are coated with the tub rear wall. Actually, all the chambers 125 accommodate the tub rear wall and are filled with the tub rear wall. Further, walls of all the chambers 125 are coated with the tub rear wall. Due to the chambers 123, the contact area between the tub rear wall and the bearing housing 100 is remarkably increased and the adhesion strength between them is increased accordingly. Further, the formation of the chambers 125 structurally reinforces the bearing housing 100, especially, the flange 120. This also results in improvement of the stiffness and strength of the tub rear wall. Furthermore, as shown in the drawings, the through-hole 120*e* is provided in each of the chambers 125. The interaction between the through-hole 120*e* and the chambers 125 improves the adhesion strength between the tub and the bearing housing 100 and the stiffness and strength of the tub rear wall.

Moreover, the chambers 125 have different sizes. More specifically, as shown in the drawings, sizes of the chambers 125 serially arranged along the radial direction of the bearing housing 100 are different from each other. In contrast, the chambers 125 serially arranged along the circumferential direction of the bearing housing 100 have the same size. The sizes of the chambers 125 are gradually increased along the radial direction of the bearing housing 100. In other words, the chambers 125 arranged at a radially outer portion of the flange 120 may be greater than the chambers arranged at a radially inner portion thereof. Although the driving shaft 41 is rotatably supported by the bearing 43 within the bearing housing 100, a sudden starting or a sudden change of rotational direction in the motor 70 and the driving shaft 41 will apply the torsion to the tub rear wall, and the repetition of this torsion may cause fatigue. Such torsion may be increased as the diameter is increased from the center of the tub rear wall. As mentioned above, the chambers 125 arranged at the radially outer portion of the flange 120 have larger contact areas than the chambers 125 arranged at the radially inner portion, because of their larger sizes. As a result, the chambers 125 at the radially outer portion of the flange 120 have the greater adhesion strength with the tub and the greater stiffness and strength, compared with other chambers. Such an arrangement of the chambers 125 may allows sufficient stiffness and strength to the tub rear wall, against the torsion increasing along the radial direction. The chambers 125 may be formed by cutting out the flange 120, specifically, the second surface 120*b* of the flange 120. Alternatively, the chambers 125 may be formed by the circumferential and radial ribs 122 and 124 that cross each other.

More specifically, the bearing housing 100 may include first chambers 125*a* arranged around the hub 110. The bearing housing 100 may include second chambers 125*b* arranged around the first chambers 125*a* and third chambers 125*c* arranged around the second chambers 125*b*. As mentioned above, the first chambers 125*a* are serially arranged along the circumferential direction, with the same sizes, and the second and third chambers 125*b* and 125*c* have the same configuration. In addition, the first, second and third chambers 125*a*, 125*b* and 125*c* are serially arranged along the radial direction and the sizes of them are increasing along the radial direction as mentioned above. In other words, the second chambers 125*b* are larger than the first chambers 125*a* and the third chambers 125*c* are larger than the second chambers 125*b*. Those chambers can reinforce the stiffness and strength of the bearing housing 100 and the tub rear wall with respect to the torsion generated in the tub rear wall, as mentioned above.

Figure 7:
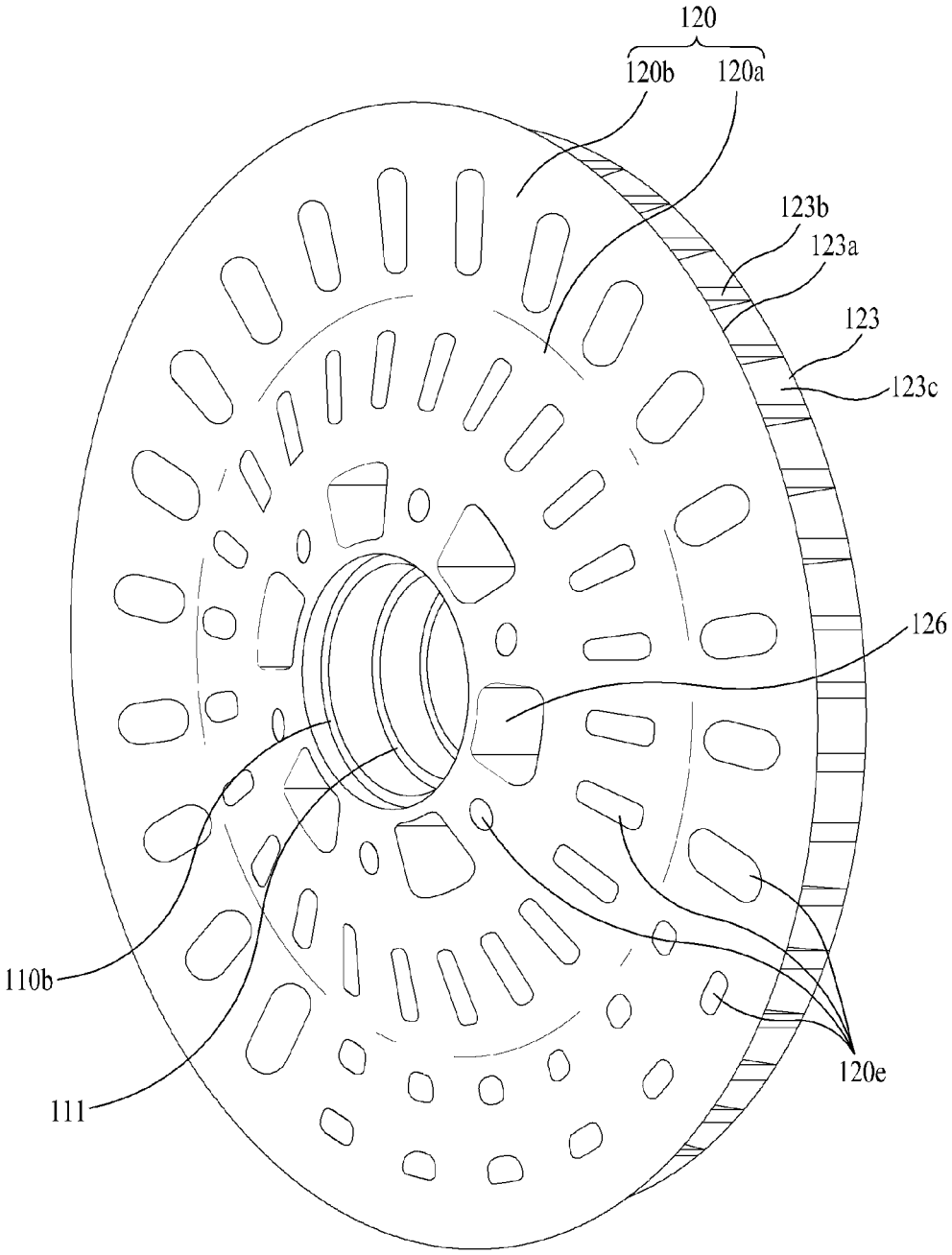

As shown in FIGS. 4 and 7, the bearing housing 100 includes at least one recess 126 arranged around the hub 110. The recess 126 is formed at the flange 120, specifically, the first extension 120*a* of the flange 120. More specifically, the recess 126 may be arranged adjacent to the drum 40, i.e. to face the drum 40. In other words, the recess 126 is arranged around the first end 110*a* of the hub 110 adjacent to the drum 40 and is also provided on the first surface 120*d* of the flange 120 adjacent to the drum 40. Such a recess 126 is extended toward the motor 70. The recess 126 receives the tub rear wall. In other words, the recess 126 is filled with the tub rear wall. Due to the recess 126, the contact area between the tub rear wall and the bearing housing 100 increases and the adhesion strength also increases. The recess 126 is arranged around the hub 110, to support the hub 110 and to structurally reinforce the hub 110. For such a reason, the bearing housing may include the plurality of the recesses 126 arranged around the hub 110 as shown in FIG. 7. The recesses 126 are arranged around the hub 110, with the same diameters from the center of the bearing housing 100. Circumferential distances between two adjacent recesses 126 are identical. Therefore, the recesses 126 may greatly reinforce the strength of the hub 110. As mentioned above, many radial ribs cannot be arranged around the hub 110 for a design reason. Accordingly, as shown in FIGS. 4, 6 and 8, the bearing housing includes an auxiliary flange 126*a*, i.e. horizontal rib provided between the fastening boss 121 and the hub 110. In other words, the auxiliary flange 126*a* connects the fastening bosses 121 and the hub 110 with each other. Such an auxiliary flange 126*a* may be substantially extended along the circumferential and horizontal direction and they may be arranged between the radial ribs 124 without difficulties in an aspect of design. At the same time, the auxiliary flange 126*a* may support the fastening boss 121 to be reinforced structurally, instead of the radial ribs. Meanwhile, as the recesses 126 and the auxiliary flange 126*a* are arranged around the hub 110, they are adjacent to each other. Therefore, the auxiliary flange 126*a* may be designed to form a bottom of the recess 126. In other words, the auxiliary flange 126*a* may be integrally formed with the recesses 126 as one body. This integral formation allows the bearing housing 100 to be designed more efficiently such that the manufacturing process of the bearing housing 100 may be simplified and usage of a raw material may be reduced.

Figure 10:
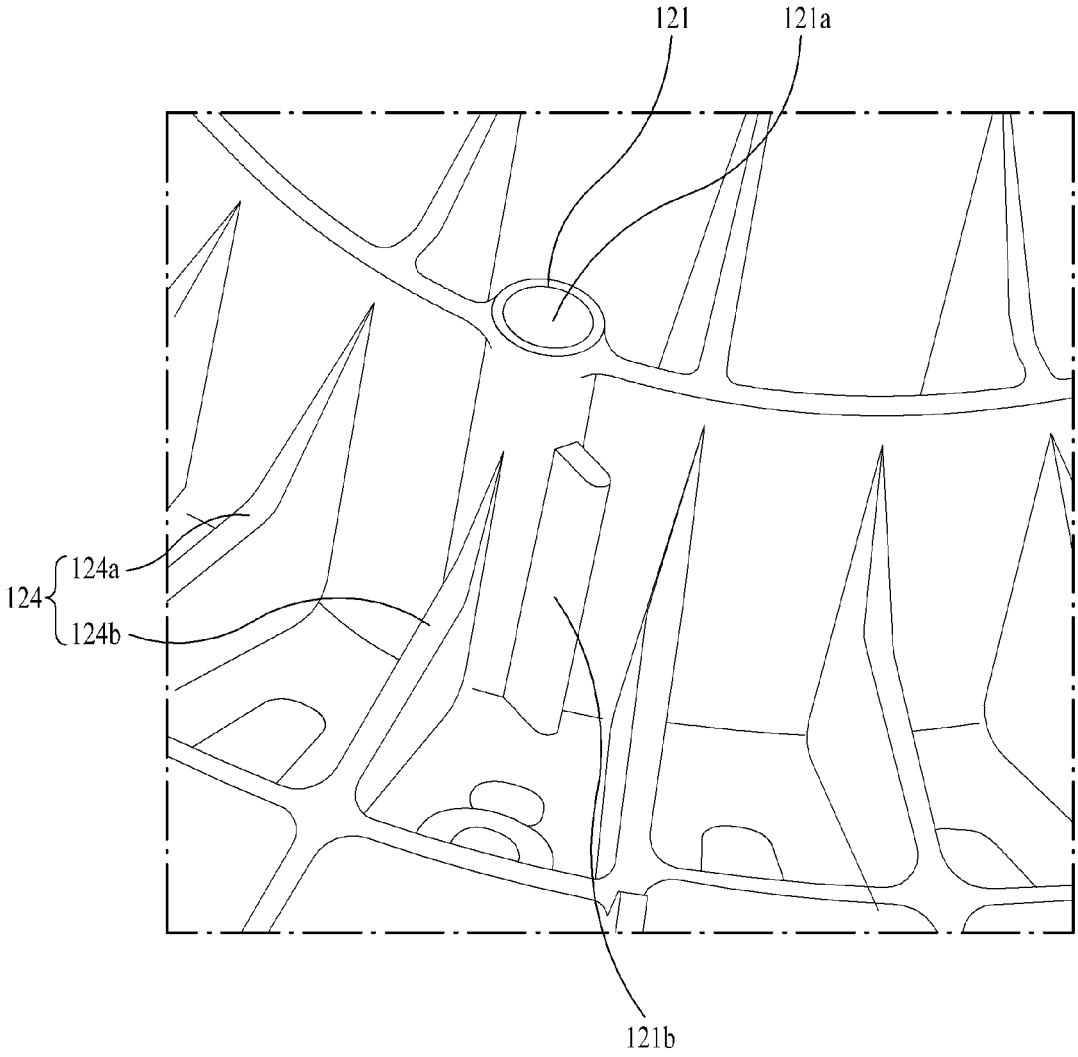
FIG. 10 is a perspective view partially illustrating the bearing housing.
Figure 11:
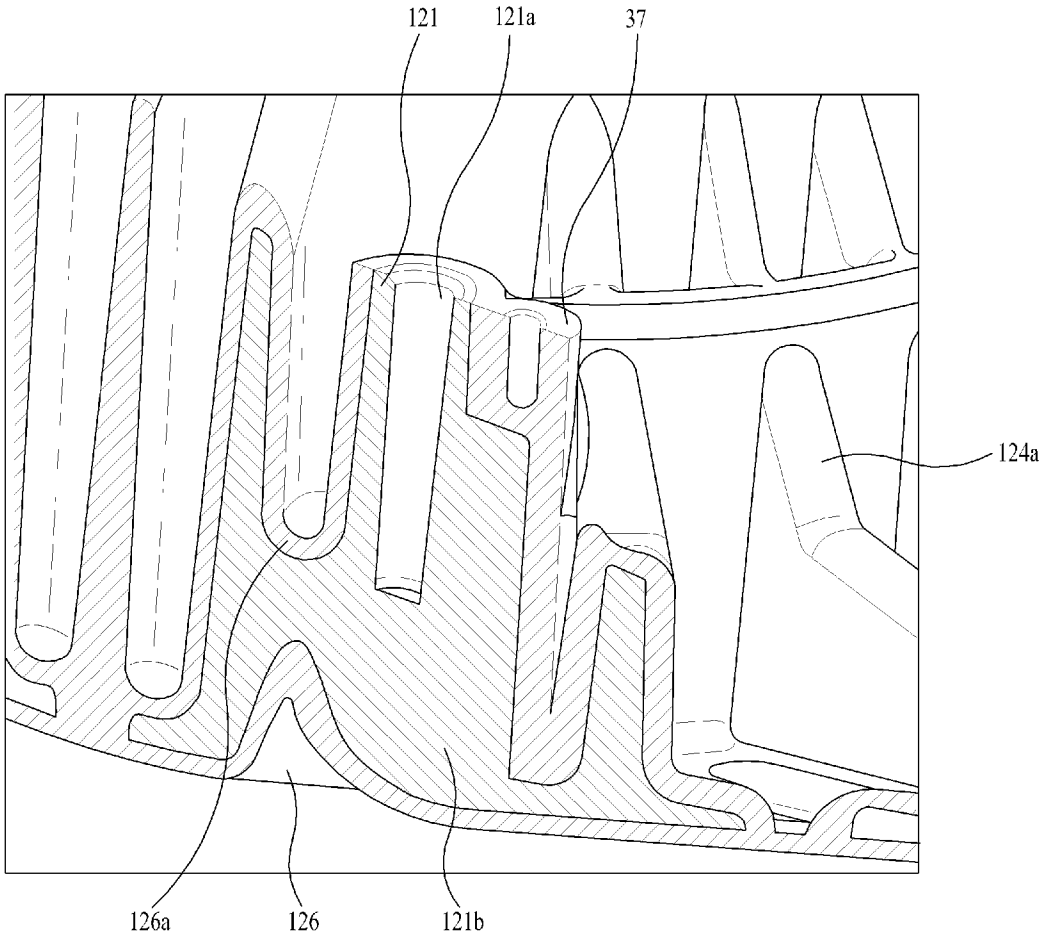
FIG. 11 is a perspective view partially illustrating the tub-bearing housing assembly.

As mentioned above, the mounting process of the stator 50 requires alignment of fastening holes 53*a* and 121*a* formed in the stator and the fastening bosses, respectively. However, the alignment is not easy, because the stator 50 is quite heavy. Accordingly, the washing machine has a positioning structure for locating the stator 50 on the tub rear wall to align the fastening holes 53*a* and 121*a*. The positioning structure may comprises a positioning groove 37 formed in the tub rear wall as shown in FIG. 11 and a positioning projection 54 provided in the stator 50 as shown in FIG. 5. The positioning groove 37 may be adjacent to the fastening bosses 121 or the fastening holes 121*a*. Similarly, the positioning projection may be arranged adjacent to the fastening part 53 or the fastening hole 53*a*. When the stator 50 is mounted to the tub 30, the positioning projection 54 is inserted in the positioning groove 37 and thereby the stator 40 is then arranged at a precise position to align the securing holes 53*a* and 121*a*. As a result, the alignment of the fastening holes and the mounting process of the stator may be performed smoothly. The positioning groove 37 may be provided in the stator, instead of the tub. Similarly, the positioning projection 37 may be provided in the tub, instead of the stator. If the positioning groove 37 is formed only by the plastic tub rear wall, such a positioning groove 37 may not have a sufficient stiffness and strength. Accordingly, the positioning groove 37 may be damaged in the mounting process. For that reason, as shown in FIG. 10, the bearing housing further includes a supporting part 121*b* configured to support the positioning groove 37. The supporting part 121*b* is formed on the flange 120 and is extended toward the positioning groove 37. More specifically, the supporting part 121*b* supports a boss of the tub rear wall which forms the positioning groove 37. The positioning groove 37 is structurally reinforced by the supporting part 121*b*, so as not to be damaged during the mounting process of the stator. The supporting part 121*b* may be connected to the fastening boss 121. In this case, the supporting part 121*b* supports the fastening boss 121 and the positioning groove 37 at the same time. Such the multi-purpose supporting part 121*b* enables an efficient design of the bearing housing 100 to simplify the manufacturing process and to reduce the material.

As described in detail before, the bearing housing 100 has various structures provided to the hub 110 and the flange 120, in addition to the hub 110 and the flange 120. For example, the step 111 and the recess 112 are provided to the hub 110. Therefore, It may be recognized that the bearing housing 100 includes the step 111 and the recess 112 and at the same time, the hub 110 also includes the step 111 and the recess 112. In addition, the fastening 121, the ribs 123 and 124, the partition 123, the chambers 125 and the recess 126 are provided to the flange 120. Likewise, it may be recognized that the flange 120 or the bearing housing 100 includes not only those structures 121 to 126 but also all of the auxiliary structures further provided to the structures 121 to 126. As mentioned above, since the bearing housing 100 may be manufactured to have a single body using the die casting or other methods, not only the hub 110 and the flange 120 but also all of the structures provided to both of them, that is, the main structures 111, 112, 121 to 127 mentioned above and the auxiliary structures provided to the main structures are all formed as one body. For the same reason, the bearing housing 100, that is, the hub 110, the flange 120 and the auxiliary structures provided to the hub 110 and the flange 120 may be all formed with the tub, specifically, the tub rear wall as one body.

Moreover, the bearing housing 100, that is, the hub 110, the flange 120 and/or the auxiliary structures may be buried in the rear wall of the tub 30. Also, the bearing housing 100, that is, the hub 110, the flange 120 and/or the auxiliary structures may be embedded in the rear wall of the tub 30. In other words, the bearing housing 100, that is, the hub 110, the flange 120 and/or the auxiliary structures may be entirely arranged in the tub the rear wall not to be exposed to the outside of the tub rear wall. More specifically, the bearing housing 100, that is, the hub 110, the flange 120 and/or the auxiliary structures provided therein may be enclosed by the tub rear wall, except the step 111 provided in the hub 110. Furthermore, the bearing housing 100, that is, the hub 110, the flange 120 and/or the auxiliary structures provided therein may be entirely enclosed by the tub rear wall. Alternatively, the bearing housing 100, that is, the hub 110, the flange 120 and/or the auxiliary structures may be arranged between the outer surface and the inner surface of the tub rear wall. At least surfaces of the bearing housing 100, that is, the hub 110, the flange 120 and/or the auxiliary structures, which are adjacent to the stator, may be covered by the tub rear wall. Furthermore, the surfaces of the bearing housing 100, that is, the hub 110, the flange 120 and/or the auxiliary structures, which are adjacent to the stator, may be entirely covered by the tub rear wall. Alternatively, the tub rear wall is arranged between the stator 50 and the flange 120 (including the auxiliary structures) and this tub rear wall covers the flange 120 and the auxiliary structures provided in the flange 120.

It could be appreciated from the related drawings and description that the general characteristics or features of the bearing housing 100 mentioned above may be separately applicable to each of the components (the hub 110, the flange 120 and the auxiliary structures)

Figure 13:
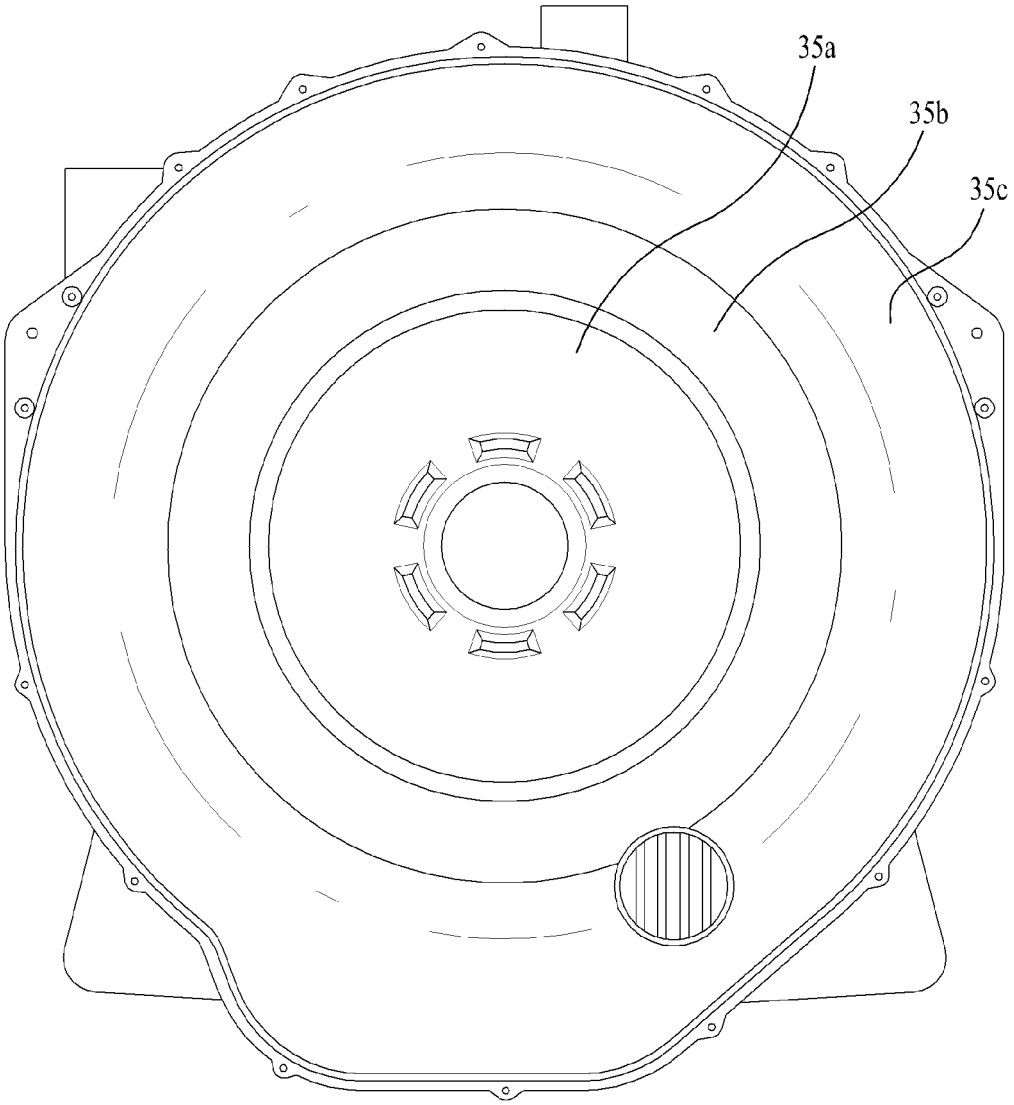
FIG. 13 is a plane view illustrating an inner portion of the tub-bearing housing assembly.

FIGS. 12 and 13 are plane views illustrating an outer portion and an inner portion of the tub rear wall having the bearing housing embedded therein.

As described above, through the molding process, the tub rear wall encloses the bearing housing 100 and covers an outer surface of the bearing housing 100. Accordingly, as shown in FIG. 12, an outer portion of the tub rear wall has the profile corresponding to the profile of the bearing housing 100. In other words, the outer portion of the tub rear wall has the profile substantially identical or similar to the profile of the parts of the bearing housing 100 adjacent to the outer portion. More specifically, the outer portion of the tub rear wall includes a boss 31, circumferential ribs 32 and radial ribs 34, corresponding to the fastening boss 121, the circumferential ribs 122, the partition 123 and the radial ribs 124 of the bearing housing 100. The boss 31, the circumferential ribs 32 and the radial ribs 34 are provided at portions the outer surface of the tub rear wall, corresponding to the fastening boss 121, the circumferential ribs 122, the partition 123 and the radial ribs 124 of the bearing housing. In other words, the boss 31, the circumferential ribs 32 and the radial ribs 34 are disposed above the fastening boss 121, the circumferential ribs 122, the partition 123 and the radial ribs 124 of the bearing housing. Like the boss 31 and the ribs 32 and 34, the outer portion of the tub rear wall includes first to third recesses 36*a*, 36*b* and 36*c* as shown in FIGS. 3 and 4, corresponding to the first to third recesses 100*a*, 100*b* and 100*c* of the bearing housing. Likewise, the first to third recesses 36, 36*b* and 36*c* are disposed above the first to third recesses 100*a*, 100*b* and 100*c* of the bearing housing. As shown in FIGS. 3 and 4, the tub rear wall has a skirt 33 surrounding the motor 70. The skirt 33 is spaced apart from the motor 70 and is extended from the tub rear wall toward the motor 70. The skirt 33 prevents leaked wash water or foreign substances from entering the motor 70. In addition, a boss 39 is provided at the outer portion of the tub rear wall for a transit bolt. As the transit bolt is fastened to the boss 39, passing through the wall of the housing, the devices attached to the tub such as the motor and the drum may be secured not to be damaged while the washing machine is transported. The boss 39 has a fastening hole having the transit bolt fastened thereto. Since the fastening hole has a relatively small diameter, the fastening hole and the boss 39 might be easily deformed after the molding. Therefore, the fastening hole of the boss 39 is formed as through-hole. Such a fastening hole may cool the boss 39 immediately after the molding, to prevent the deformation of the boss 39.

As shown in FIG. 13, the inner portion of the tub rear wall has the profile corresponding to the profile of the bearing housing 100 for the same reason mentioned above. That is, inner surfaces of the tub rear wall have the profile which is substantially identical or similar to the profile of neighboring parts of the bearing housing 100. As mentioned above, the projected components such as the fastening boss 121, the ribs 122 and 124 and the partition 123 are all disposed on the second surface 120*d* of the flange 120, to be adjacent to the motor 70. Accordingly, the portions of the bearing housing 100 adjacent to the inner portion of the tub rear wall are formed substantially to be smooth. In other words, the first surface 120*d*, that is, the front surface of the flange 120 which faces the inner surface of the tub rear wall is smooth. As a result, the inner surface of the tub rear wall is formed to be smooth. The inner portion and inner surface of the tub rear wall may not include large projections or recesses. Specifically, the inner portion of the tub rear wall includes a first extension 35*a* corresponding to the first extension 120*a* of the bearing housing and a second extension 35*b* corresponding to the second extension 120*b* of the bearing housing. In addition, the inner portion of the tub rear wall includes a curved portion 35*c* connecting the rear wall and side walls. The drum is rotated at a high speed and thus strong air flow is then generated between the inner surface of the tub rear wall and a rear wall of the drum. If the inner surface of the tub rear wall includes substantially large projections and recesses, severe noise might be generated by the strong air flow. However, as the inner surface of the tub rear wall is formed smooth entirely, the noise caused by the air flow may not be generated, and overall noise generated during the operation of the washing machine may be then reduced noticeably. In addition, the inner portion and the inner surface of the tub rear wall may be smooth, any projections which could interfere with the drum 40 does not exist. As a result, the size of the drum 40 may be designed larger in the same sized tub 30 by the smooth inner surface and inner portion of the tub rear wall. Moreover, the various design improvement mentioned above repeatedly may allow the tub rear wall to be compact. Therefore, the tub 30 may be designed larger within the same sized housing and the drum 40 may be also designed larger accordingly. The drum 40 may be substantially enlarged by the compact tub rear wall and the smooth inner surface and inner portion of the tub rear wall. As a result, the washing capacity of the washing machine may be increased without the increased size (that is, the volume) of the washing machine. This design improvement may enhance productivity and decrease production cost. In addition, the design improvement enables a washing machine to have an increased washing capacity, without a substantial price increase, and thereby provides users with substantial benefit.

According to the examples of the present application, the improvement in design and assembly process of the bearing housing and the tub rear wall is achieved. Therefore, the tub of the washing machine is structurally reinforced and productivity may be increased. Furthermore, due to the improvement of the design and manufacture process, the washing capacity is increased even without increasing an overall size of the washing machine, and the vibration and noise are reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A washing machine comprising:

a tub configured to store wash water therein;

a drum rotatably installed in the tub and accommodating laundry therein;

a driving shaft connected with the drum;

at least one bearing configured to support the driving shaft;

a motor mounted to a rear wall of the tub and connected to the driving shaft; and a bearing housing comprising a hub configured to accommodate the at least one bearing and a flange provided around the hub and coupled to a stator of the motor, the flange extending outwardly in a radial direction, wherein the flange comprises a conical first extension extending from an end of the hub, the end of the hub adjacent to the drum, and a second extension extending from the first extension outwardly along a radial direction, perpendicular to a center axis of the hub, wherein the conical first extension has at least one recess, and wherein the at least one recess is extended toward the motor and is filled with the tub rear wall for increasing a contact area between the tub rear wall and the bearing housing.

2. The washing machine of claim 1, wherein the flange of the bearing housing is disposed in the rear wall of the tub.

3. The washing machine of claim 1, wherein the flange of the bearing housing is entirely enclosed by the rear wall of the tub.

4. The washing machine of claim 1, wherein an outer surface of the flange of the bearing housing is entirely covered by the rear wall of the tub.

5. The washing machine of claim 1, wherein the bearing housing is buried in the rear wall of the tub.

6. The washing machine of claim 1, wherein the first extension inclines toward the motor.

7. The washing machine of claim 1, wherein a groove is formed at an end surface of the hub which faces the motor, and a portion of the tub fills up the groove.

8. The washing machine of claim 1, wherein the bearing housing comprises a plurality of radial ribs and a plurality of circumferential ribs which are provided on the flange.

9. The washing machine of claim 1, wherein the bearing housing comprises a plurality of chambers provided to the flange and receiving the rear wall of the tub.

10. The washing machine of claim 1, wherein the first extension has a continuous portion on the same plane along a circumferential direction.

11. The washing machine of claim 1, wherein the first extension has a continuous portion on the same plane along a closed loop and the hub is disposed inside the closed loop.

* * * * *